US012790919B2

(12) United States Patent
Glaesman et al.

(10) Patent No.: US 12,790,919 B2
(45) Date of Patent: Nov. 10, 2026

(54) FLUOROPLASTIC BASED LINER HANGERS FOR GEOTHERMAL AND CORROSIVE ENVIRONMENTS

(71) Applicant: Halliburton Energy Services, Inc., Houston, TX (US)

(72) Inventors: Chad W. Glaesman, Singapore (SG); Sandeep Thatathil, Singapore (SG); Vishal Vilas Raut, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 37 days.

(21) Appl. No.: 18/636,713

(22) Filed: Apr. 16, 2024

(65) Prior Publication Data

US 2025/0320793 A1 Oct. 16, 2025

(51) Int. Cl.
*E21B 43/10* (2006.01)
*E21B 33/04* (2006.01)

(52) U.S. Cl.
CPC ..... *E21B 43/103* (2013.01); *E21B 33/04* (2013.01)

(58) Field of Classification Search
CPC ..... E21B 33/04; E21B 43/103
See application file for complete search history.

(56) References Cited

U.S. PATENT DOCUMENTS

| | | | | |
|---|---|---|---|---|
| 3,933,550 | A | 1/1976 | Erwin | |
| 3,939,027 | A | 2/1976 | Ohya et al. | |
| 4,902,574 | A | 2/1990 | Lee | |
| 6,346,328 | B1 | 2/2002 | Parsonage et al. | |
| 9,290,624 | B2 | 3/2016 | Bish et al. | |
| 2013/0207312 | A1* | 8/2013 | Hench | B29C 43/027 264/313 |
| 2015/0345249 | A1 | 12/2015 | Gorrara et al. | |
| 2017/0342797 | A1 | 11/2017 | Murphree et al. | |
| 2018/0016864 | A1* | 1/2018 | Parekh | E21B 33/1291 |
| 2018/0094509 | A1 | 4/2018 | Braddick | |
| 2019/0330943 | A1 | 10/2019 | Givens et al. | |
| 2024/0117716 | A1* | 4/2024 | Zhong | E21B 33/04 |

FOREIGN PATENT DOCUMENTS

| | | | |
|---|---|---|---|
| AU | 2014253094 | 11/2015 | |
| AU | 2019445291 | 9/2021 | |
| AU | 2019451953 | 9/2021 | |
| CA | 2811262 | 3/2011 | |
| WO | WO-2009148320 A1 * | 12/2009 | E21B 33/038 |

OTHER PUBLICATIONS

Rogov, et al., "Metal-Fluoroplastic Materials for Aviation Structural Elements", Proceedings of the International Conference "Aviamechanical engineering and transport" (AVENT 2018) Advances in Engineering Research, vol. 158, May 2018, 4 pages.
"PCT Application No. PCT/US2024/024832 International Search Report and Written Opinion", Jan. 6, 2025, 10 pages.
"NL 2039951 Search Report", Oct. 31, 2025, 7 pages.

* cited by examiner

*Primary Examiner* — Dany E Akakpo
(74) *Attorney, Agent, or Firm* — DeLizio, Peacock, Lewin and Guerra, LLP

(57) ABSTRACT

Some implementations include a method comprising positioning a fluoroplastic sleeve on a body of a liner hanger configured for insertion in a borehole. The method also may include heating the fluoroplastic sleeve.

19 Claims, 10 Drawing Sheets

FLUOROPLASTIC BASED LINER HANGERS FOR GEOTHERMAL AND CORROSIVE ENVIRONMENTS

TECHNICAL FIELD

The disclosure generally relates to the field of subsurface operations and, more specifically, to liner hangers for use in geothermal and corrosive environments.

BACKGROUND

Liner hanger systems may be used in subsurface wells to extend a liner from the bottom of a cemented casing string. Traditional expandable liner hangers may use elastomeric elements in their construction. For example, an elastomeric element may be used between the anchoring spikes designed into the metallic body of the liner hanger. The elastomeric element may include an elastomeric ring positioned circumferentially around the liner hanger body, the elastomeric ring configured to form a fluidic seal and to provide mechanical support to the anchoring spikes. The elastomeric elements traditionally contact an internal surface of a downhole casing via expansion.

BRIEF DESCRIPTION OF THE DRAWINGS

Aspects of the disclosure may be better understood by referencing the accompanying drawings.

DESCRIPTION

The description that follows includes example systems, methods, techniques, and operational flows that embody aspects of the disclosure. However, this disclosure may be practiced without these specific details. For clarity, some well-known structures and techniques have been omitted.

Overview

An expandable liner hanger may include a metallic body with rubber wrapped on it. Fluorocarbon elastomers (FKM) may be used as the rubber wrap materials (such as for high temperature applications). Traditional processes for manufacturing liner hangers wrapped with rubber may include extruding/wrapping calendared elastomers on to the metallic body and then vulcanizing/curing them in autoclaves. However, traditional manufacturing processes may be unsuitable for liner hangers wrapped in fluoroplastics (such as PTFE, PFA, ETFE, PVDF). The novel methods for manufacturing liner hangers wrapped in fluoroplastic include: sleeve insertion with or without machined spike; sleeve welding; shrink fitting sleeves; layer wrapping and molding; spiral-cut sleeve insertion; 3D printing of sleeves to liner hanger body; crimping of fluoroplastic sleeves to liner hanger body; and molding of fluoroplastic sleeves on to liner hanger.

Description of Some Implementations

Figure 1:
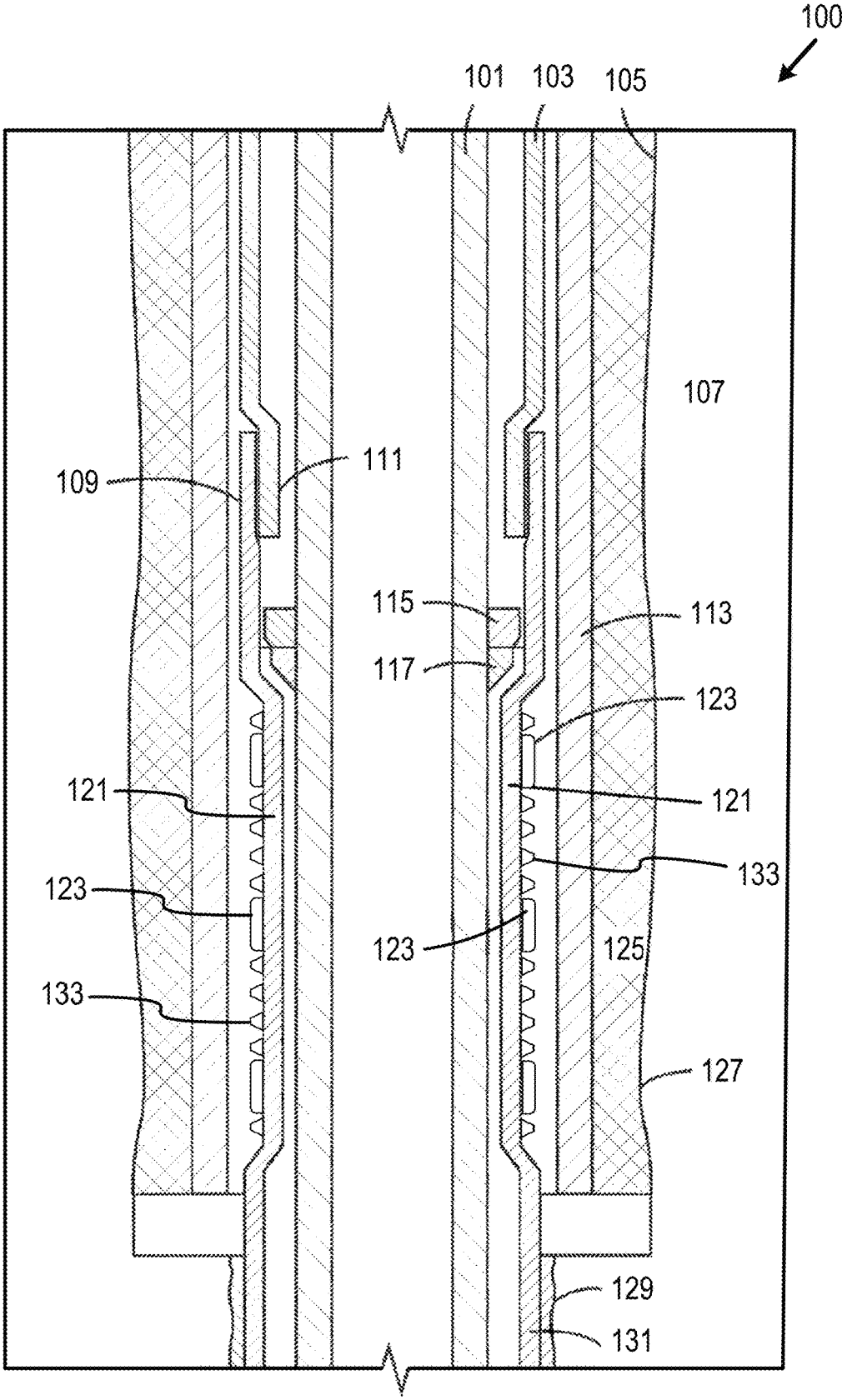
FIG. 1 is a longitudinal section 100 diagram depicting an example expandable liner hanger system, according to some implementations.

FIG. 1 is a longitudinal section 100 diagram depicting an example expandable liner hanger system, according to some implementations. A wellbore 105 may be drilled through a subsurface formation 107. The wellbore 105 may be at least partially cased by a casing 113 that defines a cased section 127. The casing 113 may be cemented in the wellbore 105 by cement 125. A lower section 129 of the wellbore 105 may include a liner 131 and a tubing string 101 that extend into the lower section 129. The liner 131 may hang from a lower end of the casing 113 via an expandable liner hanger 121.

The expandable liner hanger 121 may include a plurality of anchoring spikes 133 and one or more sealing elements 123 positioned circumferentially around an exterior of the expandable liner hanger 121. Some implementations of the expandable liner hanger 121 may include a differing quantity of anchoring spikes 133 and sealing elements 123 than depicted in FIG. 1. An upper portion of the expandable liner hanger 121 may be joined to a tie back receptacle 103 via a threaded joint 109. The expandable liner hanger 121 may include a larger inner diameter than an outer diameter of a tapered section 111 of the tie back receptacle 103. However, other implementations may use a different means of coupling the expandable liner hanger 121 and tie back receptacle 103 than the threaded joint 109.

The expandable liner hanger 121 may be expanded to sealingly engage with the casing 113 via expansion cones 115 and 117 to create an interference fit with the casing 113. The expansion cones 115, 117 may be conveyed into the wellbore 105 via the tubing string 101. Fluidic pressure applied from the surface may push the expansion cones 115, 117 through the expandable liner hanger 121. This may expand the outer diameter of the expandable liner hanger 121, and the anchoring spikes 133 and sealing elements 123 may contact the inner wall of the casing 113 to form the seal. In some implementations, the one or more sealing elements 123 may include an exterior sealing surface configured to contact the casing 113. The sealing elements 123 may be constructed with a dense, closed surface geometry in order to form the seal. However, some implementations of the sealing elements 123 may be constructed of other geometries (e.g., a lattice structure).

The anchoring spikes 133 may be metallic anchoring spikes comprised of one or more metals, alloys, or any other suitable material. For example, the anchoring spikes 133 may be comprised of any suitable steel grade, aluminum, any other ductile material, any combination thereof, etc. Each anchoring spike 133 may be a circular ring that positioned circumferentially around an outer diameter of the expandable liner hanger 121, although other configurations, spacings, quantities, and surface geometries of the anchoring spikes 133 may be possible. Each of the anchoring spikes 133 may provide a metal-to-metal seal between the expandable liner hanger 121 and an inner surface of the casing 113.

Additional sealing capability may be achieved by the sealing elements 123. The seal formed with the casing 113 may be a fluidic seal, a pressure seal, a mechanical seal, etc. One or more sealing elements 123 may be placed between a section of the anchoring spikes 133 to form the seal, increase the anchoring load of the expandable liner hanger 121, provide pressure integrity to the seal between the expandable liner hanger 121 and the casing 113, etc.

Each of the sealing elements 123 may be comprised of a thermoplastic material configured for use in high-temperature, high-pressure (HTHP) environments, standard environments, and others. For example, the sealing elements 123 may be comprised of one or more fluoroplastics including Polytetrafluoroethylene (PTFE), Fluorinated ethylene propylene (FEP), perfluoro alkoxy (PFA), Ethylene tetrafluoroethylene (ETFE), ethylene-chlorotrifluoroethylene (ECTFE), polychlorotrifluoroethylene (PCTFE), polyvinylidene fluoride (PVDF), etc. In some implementations, other fluoroplastics and/or other non-fluoroplastic fluoropolymers may also be used. The above-described fluoroplastics may have a high resistance to chemicals and solvents, very high electrical resistance, and may remain chemically stable in in both very low and very high working temperatures. For example, the volume resistivity of PVDF is approximately 1×1014 ohm/cm, the volume resistivity of FEP is approximately 1×1018 ohm/cm, and the volume resistivity of PTFE is ~1018-1019 ohm/cm. Regarding working temperatures, the above-listed fluoroplastics may have an average example operating temperature range from −200° C. up to 260° C. This temperature range may allow the sealing elements 123, and by extension, the expandable liner hanger 121, to be used in service conditions where extreme low temperature performance is required, such as in carbon capture applications. Fluoroplastic sealing elements may also enable the expandable liner hanger 121 to be used in service conditions where extreme high temperature performance is required, such as in geothermal applications.

Fluoroplastic sealing elements provide exceptional chemical and/or corrosion resistance. For example, a sealing element comprised of one of the above fluoroplastics may be configured to operate in any concentration of H2S without degradation when compared to traditional elastomeric seals. Fluoroplastic sealing elements may also offer increased corrosion resistance against other downhole corrosive elements (other than H2S) than the elastomeric compounds used in traditional sealing elements. For example, the sealing elements 123 comprised of at least one of the described fluoroplastics may be used in applications having high pH fluids, formate brines, high H2S concentrations, and most other downhole exposures where traditional elastomer sealing elements, such as those comprised of FKM, may face chemical compatibility challenges, degradation, other adverse effects, and eventual failure. Formate brines may have a pH level greater than 8, and long-term exposure to alkaline fluids may degrade traditional elastomeric sealing elements.

The above-described fluoropolymers may be thermoplastics. However, other implementations of the sealing elements 123 may use non-fluoropolymer-based thermoplastics or thermosetting plastics including polyethylene, polypropylene, nylon, phenolic, epoxy, etc. depending on an expected temperature and other environmental conditions (e.g., H2S concentration) of the wellbore 105 where the expandable liner hanger 121 is to be set. The corrosion and thermal resistance of the non-fluoropolymer sealing elements may be far lower than sealing elements comprised of the above-described thermoplastic fluoropolymers.

Figure 2A:
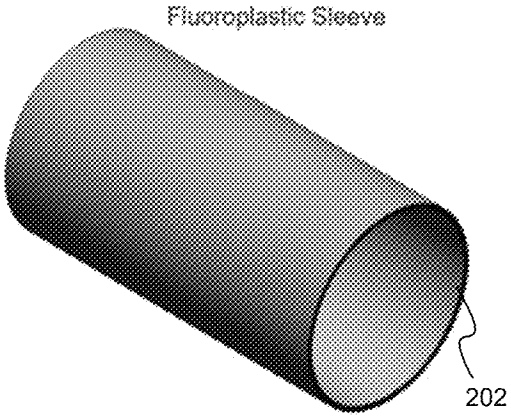
FIG. 2A is a perspective view of a sleeve for use with a downhole liner hanger.

FIG. 2A is a perspective view of a sleeve for use with a downhole liner hanger. In FIG. 2A, the sleeve 202 may have conoid, cylindrical, or any other suitable shape. The sleeve 202 may be constructed of fluoroplastic, fluor elastomer, or any other suitable material. The sleeve 202 may be deployed in the same manner as the sealing element 123. The sleeve 202 may include one or more of the materials and may exhibit one or more aspects of the sealing elements described with reference to FIG. 1.

Figure 2B:
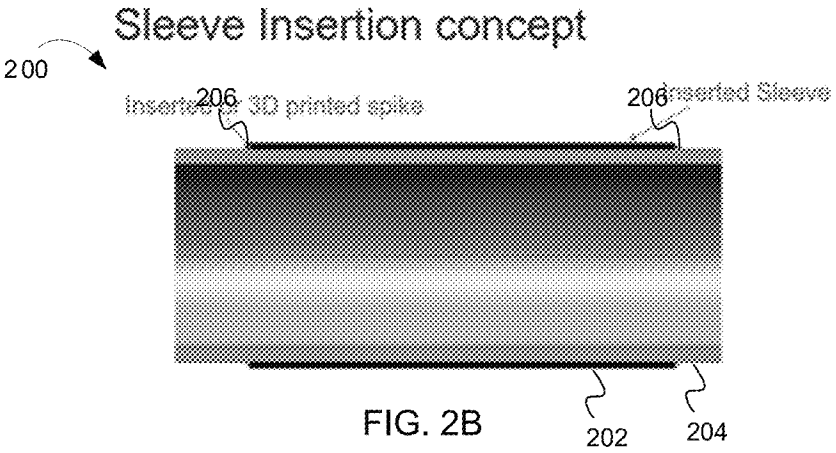
FIG. 2B is a cross sectional view of a liner hanger.

FIG. 2B is a cross sectional view of a liner hanger. The liner hanger 200 may be utilized in the manner described with reference to FIG. 1. In FIG. 2B, the liner hanger 200 includes a body 204. The body 204 may be made of metal or other suitable materials. The sleeve 202 may be inserted on the body 204 between spikes 206. The spikes 206 may be utilized in the same manner as the anchoring spikes 133 as described with reference to FIG. 1. The spikes 206 may be created by machining the body 204, bonding material to the body 204, or by any other suitable method. Although FIG. 2B shows the body 204 outfitted with a single sleeve 202, some implementations include a plurality of sleeves 202. In some implementations, operations for manufacturing the liner hanger 200 may include inserting the sleeve 202 onto the body 204, where the body 204 may or may not include one or more spikes 206. The spikes 206 may be inserted on the body 204 after the sleeve 202 is placed on the body 204.

Some implementations may manufacture the sleeve 202 via extrusion or molding the sleeve 202 to a specified length. The manufacturing process may insert the sleeve 202 on the body 204 of the liner hanger 200. The sleeve 202 may be preheated near its softening point to expand to a size suitable for sliding over the body 204 and positioning between the spikes 206 (or in a suitable place on the body 204 if there are no spikes 206). After heating and expanding, the sleeve 202 may be inserted on the body 204. After cooling, the sleeve 202 may shrink back to its original dimensions. The sleeve 202 may be created with a slightly lower internal diameter (ID) than the outer diameter (OD) of the body 204 to ensure a tight wrap and physical bonding between the sleeve 202 and the body 204. As a preparation of the body 204, the metallic surface to be cleaned and shot blasted to ensure proper gripping between the sleeve 202 and the body 204. After one or more sleeves 202 are in place, the spikes can be added to the body 204. In some implementations, the spikes 206 may be three-dimensionally (3D) printed on the body 204 or inserted through shims onto the body 204. An adhesive system may be applied on the body 204 to improve the bonding strength between the body 204 and the sleeve 202.

Figure 2C:
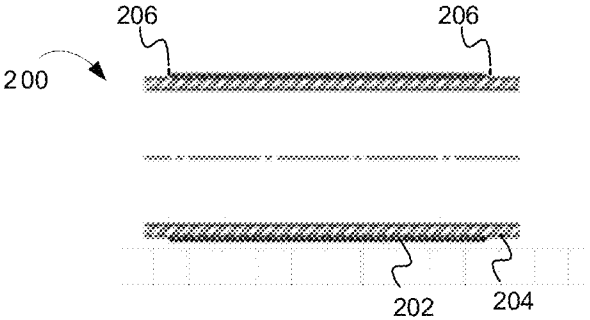
FIG. 2C is a cross sectional view of the liner hanger.

FIG. 2C is a cross sectional view of the liner hanger. In FIG. 2C, the liner hanger 200 includes the body 204, sleeve 202, and spikes 206.

Figure 3A:
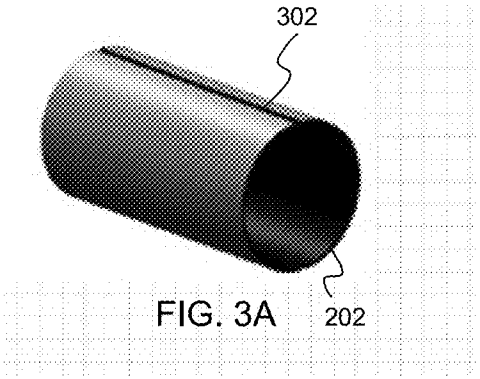
FIG. 3A is a perspective view of a sleeve suitable for a sleeve welding process.
Figure 3B:
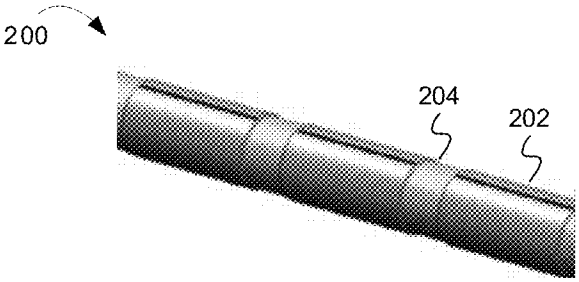
FIG. 3B is a perspective view of a liner hanger including a plurality of sleeves suitable for a sleeve welding process.
Figure 3C:
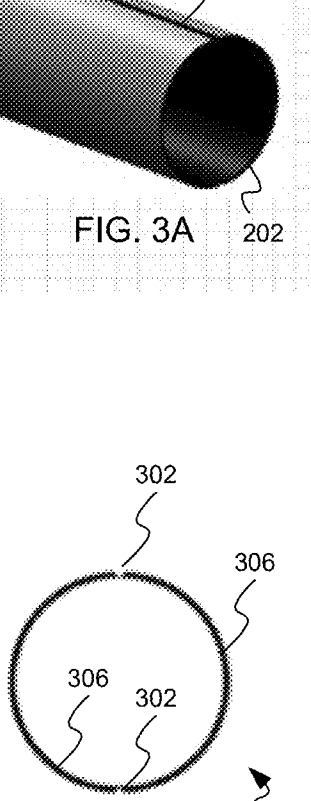
FIG. 3C is a cross sectional view of a sleeve including a plurality of voids suitable for a sleeve welding process.
Figure 3D:
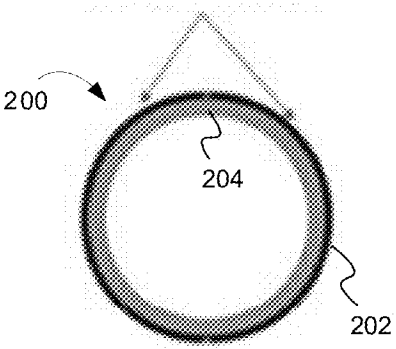
FIG. 3D is a cross sectional view of a sleeve (suitable for a sleeve welding process) on a body of a liner hanger.
Figure 3E:
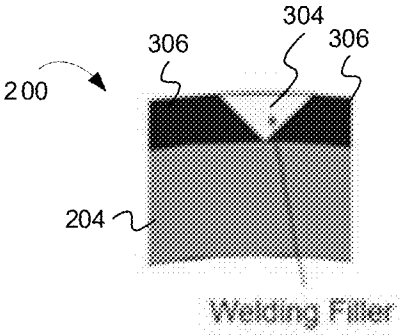
FIG. 3E is a perspective view of a sleeve with welding filler.

FIG. 3A is a perspective view of a sleeve suitable for a sleeve welding process. In FIG. 3A, the sleeve 202 includes one or more voids 302. Each void 302 may span the entire length of the of the sleeve 202. FIG. 3B is a perspective view of a liner hanger including a plurality of sleeves suitable for a sleeve welding process. FIG. 3C is a cross sectional view of a sleeve including a plurality of voids suitable for a sleeve welding process. FIG. 3D is a cross sectional view of a sleeve (suitable for a sleeve welding process) on a body of a liner hanger. FIG. 3E is a perspective view of a sleeve with welding filler.

In some implementations, a sleeve welding process is used to place the sleeve 202 on the body 204. For the sleeve welding process, the sleeve 202 may be constructed from PFA or other suitable melt-processable material. The sleeve welding process may place the sleeve 202 on the body 204 between pre-machined spikes 206. In some implementations, two semi-circle components 306 (see FIG. 3C) are attached to the body 204 to completely cover the outer surface of the body 204. Edges of the sleeve 202 may be cut to form a void 302. The void 302 may be shaped as a v-groove. Plastic welding techniques with similar welding material can be utilized to join these semi-circle components 306. In some implementations, a welding filler 304 may be used to join the semi-circle components 306 of the sleeve 202. Surface cleaning of the body 204 and blasting may improve bonding between the sleeve 202 and the body 204. Etching and application of bonding agents may improve surface activation of the sleeve 202 and bonding between the sleeve 202 and the body 204.

Figure 4A:
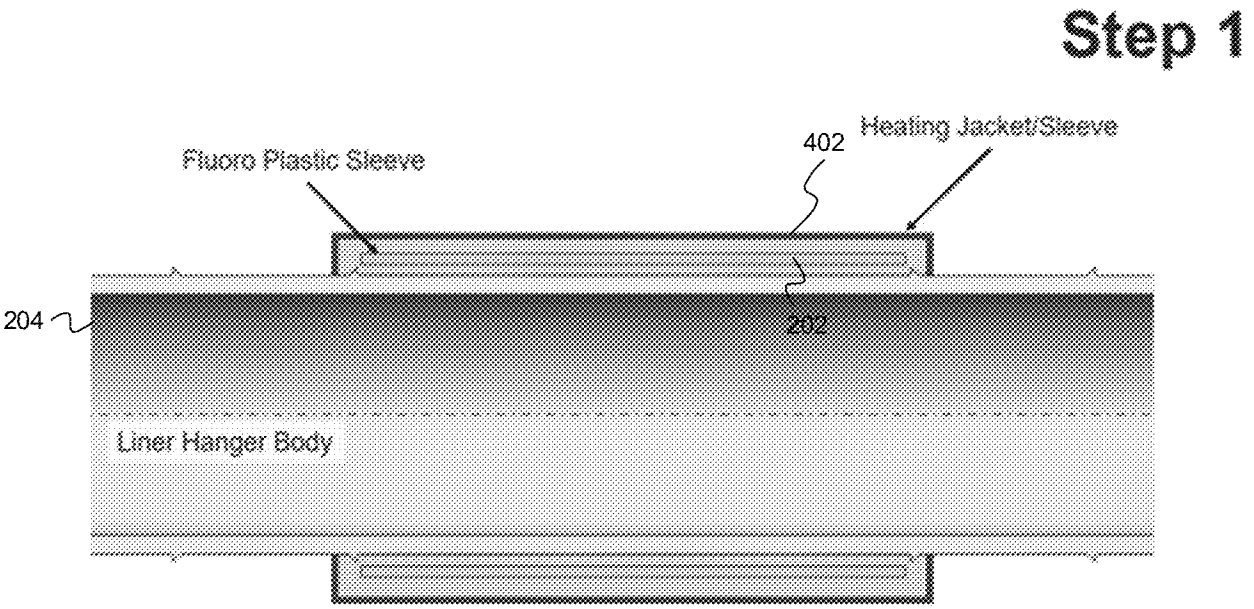
FIG. 4A is a cross sectional view of a sleeve suitable for installation on a body via a shrink-fitting process.

FIG. 4A is a cross sectional view of a sleeve suitable for installation on a body via a shrink-fitting process. The shrink-fitting process may include two steps. For step one, the sleeve 202 may be placed over the body 204. At this point, the sleeve 202 is not yet bonded to the body 204. During step two, the sleeve 202 may be bonded to the body 204. In some implementations, the sleeves 202 are manufactured with an initial ID that may be heat-shrunk to a particular size (such as a smaller ID). The thickness of the sleeve 202 and its initial ID may be chosen based on the shrinkage percentage of the sleeve 202. Surface cleaning and blasting of the metallic body may be performed before inserting the sleeve 202 on the body 204. The ID of the sleeve 202 may be etched using suitable etchant to activate the bonding surface. A suitable bonding agent, such as epoxy-based adhesive may be applied between the sleeve 202 and body 204 before shrinking of the sleeve 202. A heat gun or heating jacket 402 of suitable heating capacity may apply heat to the sleeve 202 to shrink it to final dimensions. After heat-shrinking, the sleeve 202 the process for bonding the sleeve 202 to the body 204 may be complete.

Figure 4B:
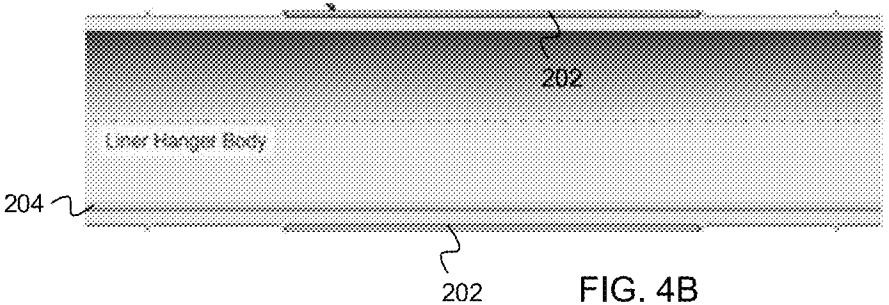
FIG. 4B cross sectional view of a body with a shrink-fitted sleeve.

FIG. 4B cross sectional view of a body with a shrink-fitted sleeve. As shown the body 204 includes the shrink-fitted sleeve 202.

Figure 5B:
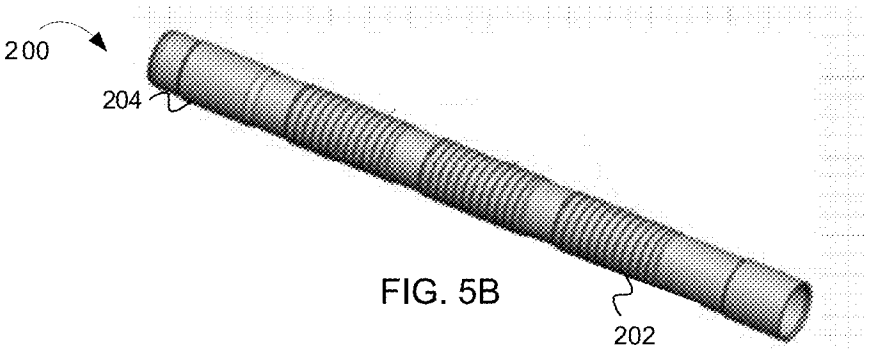
FIG. 5B is a perspective view of a spiral-cut sleeve installed on the body of the liner hanger.
Figure 5A:
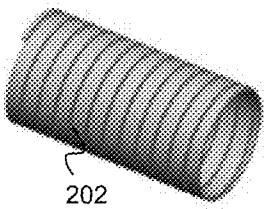
FIG. 5A is a perspective view of a spiral cut sleeve.
Figure 5C:
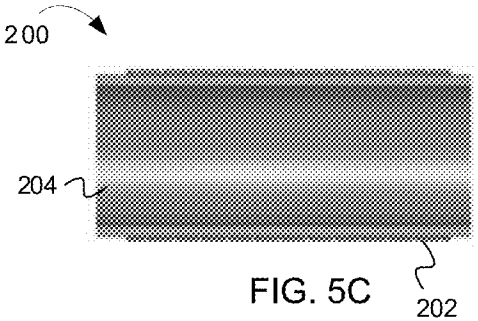
FIG. 5C is a cross sectional view of a spiral-cut sleeve installed on the body of the liner hanger.

FIG. 5A is a perspective view of a spiral cut sleeve. In FIG. 5A, the sleeve 202 has been spirally cut. FIG. 5B is a perspective view of a spiral-cut sleeve installed on the body of the liner hanger. FIG. 5C is a cross sectional view of a spiral-cut sleeve installed on the body of the liner hanger. Spiral-cut sleeves 202 may be manufactured through molding, extrusion, or any other suitable manufacturing methods to produce a conoid (or other suitably shaped sleeve) that may be spirally cut. The spiral-cut sleeve 202 may be inserted over the body of the liner hanger 200. The body 204 may be machined with spikes 206, or the spikes 206 may be created via 3D printing, insertion of shims, or by any other suitable method. After placement over body 204, the spiral-cut sleeves 202 may be heat-shrunk or welded to fit to the body. The spiral-cut sleeve may be bonded without any heat processing. Surface preparation of the body 204 and ID of the sleeve 202 may be performed (such as cleaning and blasting) and a bonding agent to be applied to improve bonding.

Figure 6:
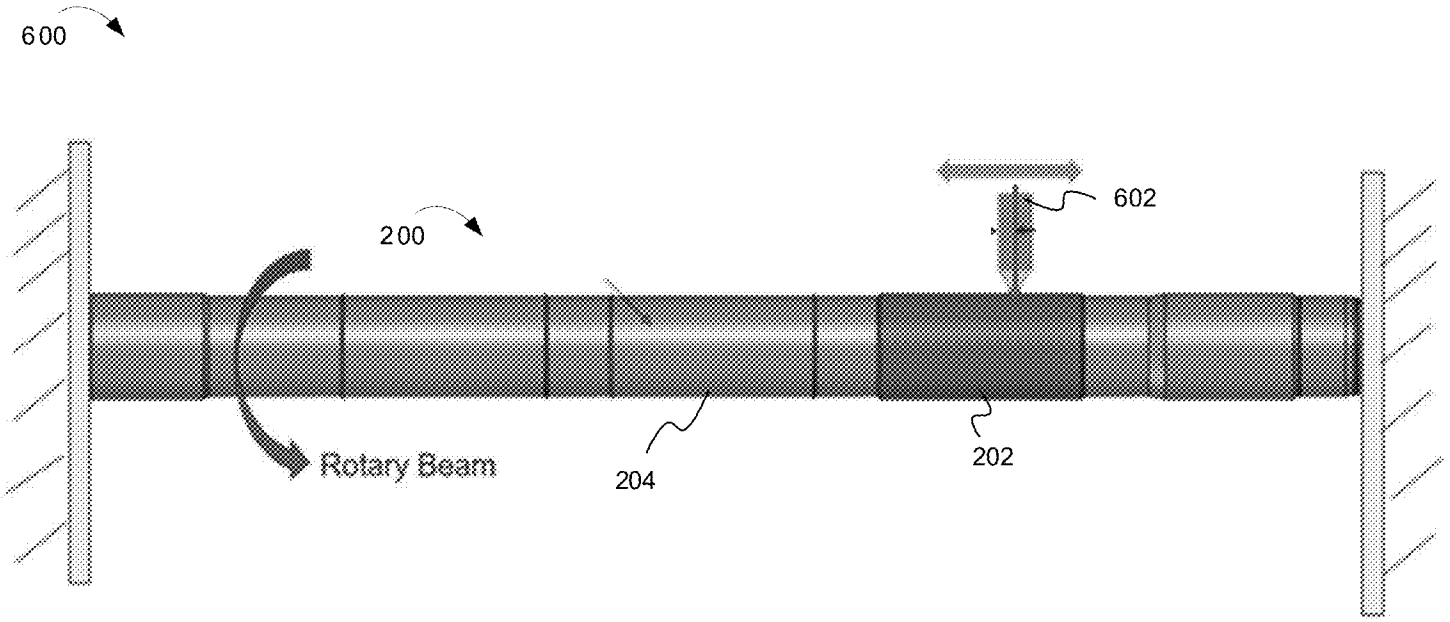
FIG. 6 is a perspective view of a 3D printer installing a sleeve on a liner hanger.

In some implementations, the sleeves 202 may be 3D printed to the body 204 of the liner hanger 200. For 3D printed sleeves 202 may be made from PVDF. In some implementations, PFA is directly printed on the body 204 of the liner hanger 200. A melted polymer or filament may be printed on the rotating liner hanger body 204 and the 3D printer's print head may later move across to print the fluoroplastic. Surface cleaning of the body 204 may be done prior to the 3D printing. FIG. 6 is a perspective view of a 3D printer installing a sleeve on a liner hanger. In FIG. 6, the 3D printer holds the body 204 and rotates the body as a print head 602 applies material to the body 204. In some implementations, the 3D printer applies the material between spikes (not shown in FIG. 6).

Figure 7B:
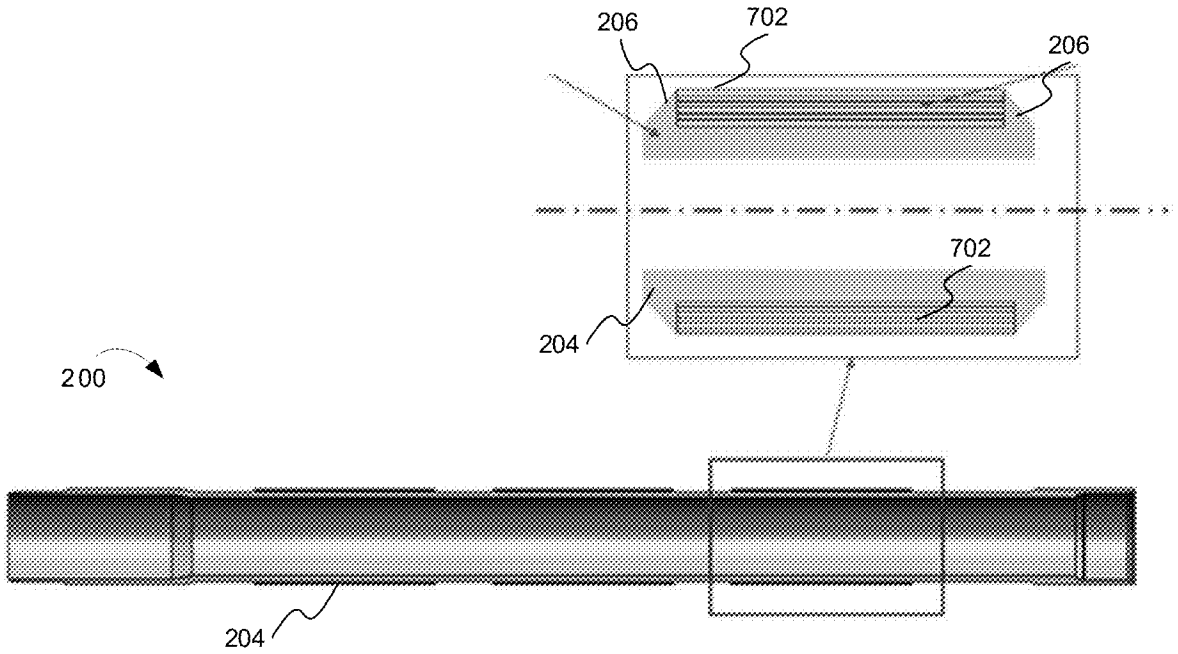
FIG. 7B is a section view of a liner hanger including a layer-wrapped sleeve.
Figure 7A:
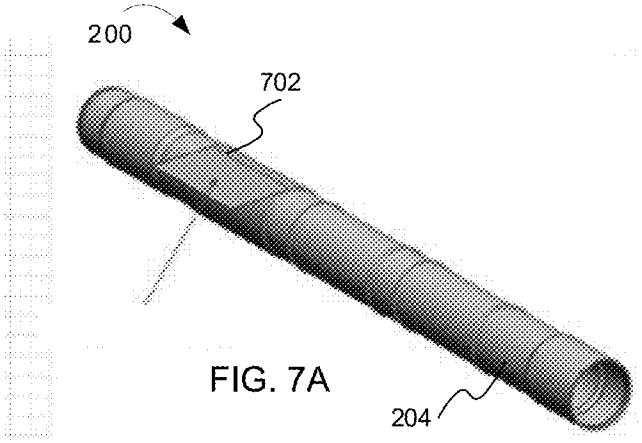
FIG. 7A is a perspective view of a liner hanger including a layer-wrapped sleeve.

In some implementations, sleeves 202 are layer-wrapped and molded on the body of the liner hanger 200. FIG. 7A is a perspective view of a liner hanger including a layer-wrapped sleeve. In some implementations, multiple layers of thin sheets of fluoroplastic 702 are wrapped around the body 204 to form the sleeves 202. Layers may be added to reach a desired thickness and then heat-processed or molded to consolidate the layers into the sleeves 202. Any undesired thickness may be removed (such as by machining). The wrapping sheet thickness can vary from 0.25 mm to 1 mm based on the fluoropolymer height specifications associated with the liner hanger 200. FIG. 7B is a section view of a liner hanger including a layer-wrapped sleeve. In FIG. 7B, the fluoroplastic layers 702 are wrapped between spikes 206.

Figure 8:
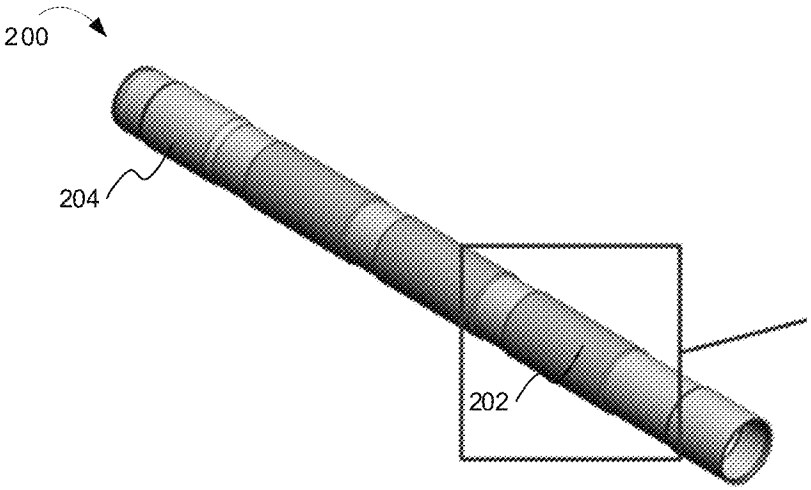
FIG. 8 is a perspective view of a liner hanger on which the sleeves have been molded.

In some implementations, the sleeve 202 is molded on to the body 204 of the liner hanger 200. In the molding process, a fluoroplastic layer may be directly molded on the body 204 through injection or transfer molding. The body 204 may be cleaned and blasted. A bonding agent may be applied on the surface of the body 204. This process may utilize fluoroplastics which are heat processable such as PFA, PVDF, and others. FIG. 8 is a perspective view of a liner hanger on which the sleeves have been molded. In FIG. 8, the sleeves 202 have been molded by the above-noted molding process.

Figure 9B:
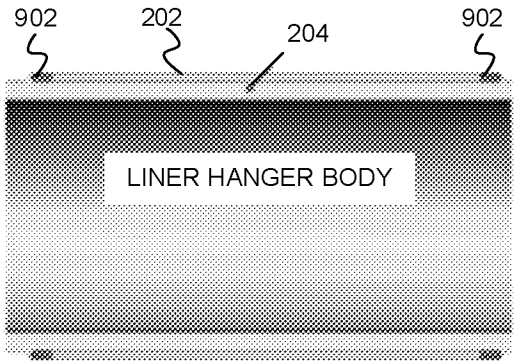
FIG. 9B is a cross sectional view of the liner hanger with crimping devices 902.
Figure 9A:
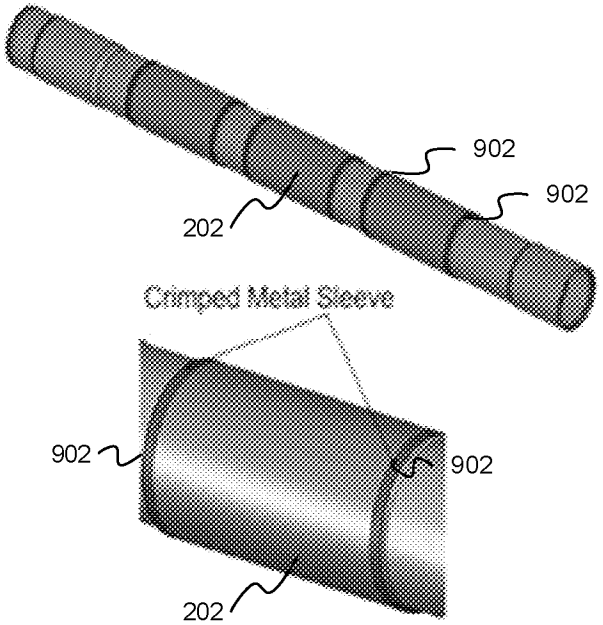
FIG. 9A is a perspective view of a liner hanger with crimping devices.

Some implementations may crimp the sleeves 202 on to the body to form the sleeves 202 with crimping devices. FIG. 9A is a perspective view of a liner hanger with crimping devices. In some implementations, both ends of the sleeves 202 are fastened to the body 204 via crimping devices 902. The crimping devices may be metallic sleeve crimps. Crimped The sleeves 202 do not require any special type of surface treatment. The metallic crimps may ensure the integration of the sleeves 202 on to the body 204 of the liner hanger 200. FIG. 9B is a cross sectional view of the liner hanger with crimping devices 902.

Figure 10:
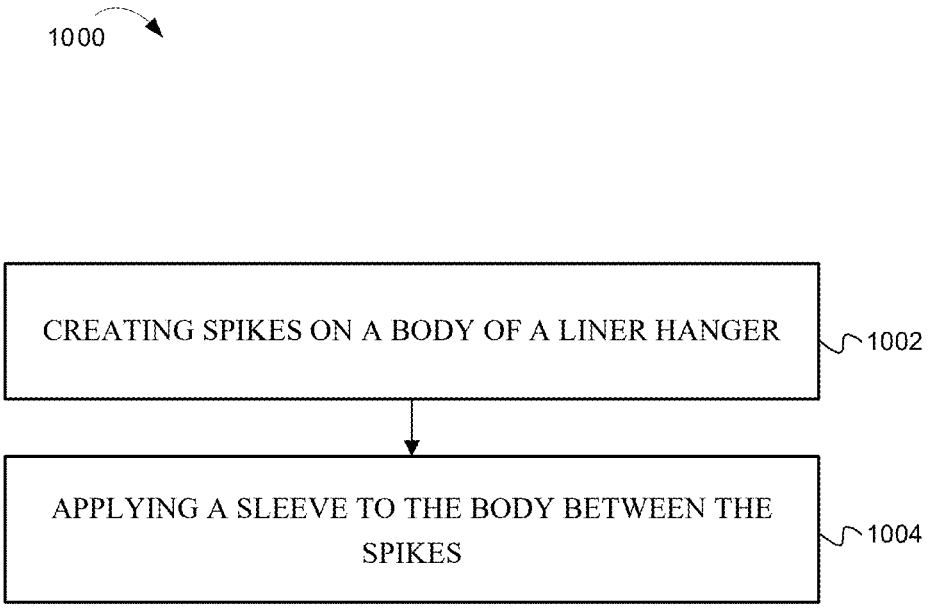
FIG. 10 is a flow diagram illustrating operations for manufacturing a liner hanger.

FIG. 10 is a flow diagram illustrating operations for manufacturing a liner hanger. At block 1002, spikes are created on a body of a liner hanger. At block 1004, a sleeve is applied to the body between the spikes.

As used herein, the term "or" is inclusive unless otherwise explicitly noted. Thus, the phrase "at least one of A, B, or C" is satisfied by any element from the set {A, B, C} or any combination thereof, including multiples of any element.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, and the principles and the novel features disclosed herein.

The various implementations may include some implementations that have all or any combination of the aspects described herein. An implementation can include any one or more of the aspects described herein.

Some implementations may aspects as described in the following clauses.

Clause 1: A method comprising positioning a fluoroplastic sleeve on a body of a liner hanger configured for insertion in a borehole; and heating the fluoroplastic sleeve.

Clause 2: The method of clause 1, wherein the heating causes the fluoroplastic sleeve to shrink and bond with the body.

Clause 3: The method of any one or more of clauses 1-2, wherein the heating is part of a plastic welding process, the method further comprising: adding a welding filler to a void in the sleeve while the fluoroplastic sleeve is hot from the heating.

Clause 4: The method of any one or more of clauses 1-3, wherein the sleeve is formed of a plurality of fluoroplastic layers positioned on the body of the liner hanger, and wherein the heating forms the plurality of fluoroplastic layers into a unitary material.

Clause 5: The apparatus of any one or more of clauses 1-4, wherein the positioning the fluoroplastic sleeve on the body places the fluoroplastic sleeve between two spikes each configured to contact a downhole surface.

Clause 6: The method of any one or more of clauses 1-5 further comprising: placing a heating jacket over the sleeve, wherein the heating jacket performs the heating of the fluoroplastic sleeve on the body.

Clause 7: A method comprising: positioning a sleeve on a body of a liner hanger configured for insertion in a borehole.

Clause 8: The method of clause 7, wherein the sleeve is constructed of fluoroplastic.

Clause 9: The method of any one or more of clauses 7-9, further including: installing metal rings on the body and in contact with the sleeve; and crimping the metal rings.

Clause 10: The method of any one or more of clauses 7-9 further comprising: spirally cutting the sleeve before positioning the sleeve on the body Clause 11: The method of any one or more of clauses 7-10, wherein the positioning includes:

Clause 12: The method of any one or more of clauses 7-11, wherein the positioning includes: extruding the sleeve from a three-dimensional printer head.

Clause 13: The method of any one or more of clauses 7-12, wherein the positioning the sleeve on the body places the sleeve between two spikes each configured to contact a downhole surface.

Clause 14: The method of any one or more of clauses 7-13 further comprising: installing spikes on the body, wherein the sleeve is positioned between the spikes Clause 15: A method comprising: creating spikes on a metal body of a liner hanger; and applying a fluoroplastic sleeve to the metal body between the spikes.

Clause 16: The method of clause 15 further comprising: spirally cutting the fluoroplastic sleeve.

Clause 17: The method of any one or more of clauses 15-16 further comprising: adding a welding filler to a void in the fluoroplastic sleeve.

Clause 18: The method of any one or more of clauses 15-17, installing metal rings on the metal body and in contact with the fluoroplastic sleeve; and crimping the metal rings Clause 19: The method of any one or more of clauses 15-18, wherein applying includes positioning a plurality of fluoroplastic layers positioned on the metal body of the liner hanger, the method further including: heating the plurality of fluoroplastic layers to form a unitary material.

Clause 20: The method of any one or more of clauses 15-19, wherein creating the spikes includes machining the metal body to form the spikes.

What is claimed is:

1. A method comprising:

positioning a fluoroplastic sleeve on a body of a liner hanger configured for insertion in a borehole; and heating the fluoroplastic sleeve, wherein the heating includes:

adding a welding filler to a void in the fluoroplastic sleeve; and applying a plastic welding process to the welding filler.

2. The method of claim 1, wherein the heating causes the fluoroplastic sleeve to shrink and bond the fluoroplastic sleeve to the body of the liner hanger.

3. The method of claim 1, wherein the positioning the fluoroplastic sleeve on the body includes placing the fluoroplastic sleeve between two spikes, each spike configured to contact a downhole surface.

4. The method of claim 1, wherein heating the fluoroplastic sleeve further includes:

placing a heating jacket over the sleeve, wherein the heating jacket performs the heating of the fluoroplastic sleeve on the body.

5. The method of claim 1 further comprising:

installing spikes on the body, wherein the sleeve is positioned between the spikes.

6. A method comprising:

positioning a fluoroplastic sleeve on a body of a liner hanger configured for insertion in a borehole; and heating the fluoroplastic sleeve, wherein the positioning includes wrapping two or more fluoroplastic layers around the body of the liner hanger such that portions of the fluoroplastic layers overlap, and wherein the heating conforms the overlapping portions of the fluoroplastic layers to the body of the liner hanger.

7. The method of claim 6 wherein positioning the fluoroplastic sleeve includes:

installing metal rings on the body of the liner hanger and in contact with the fluoroplastic sleeve; and crimping the metal rings.

8. The method of claim 6 further comprising:

spirally cutting the sleeve before positioning the sleeve on the body.

9. The method of claim 6 wherein positioning the fluoroplastic sleeve includes:

molding the fluoroplastic material onto the body of the liner hanger.

10. The method of claim 6, wherein the positioning includes:

extruding the sleeve from a three-dimensional printer head.

11. The method of claim 6, wherein the positioning the sleeve on the body includes placing the sleeve between two spikes, each spike configured to contact a downhole surface.

12. The method of claim 6, wherein heating the fluoroplastic sleeve includes placing a heating jacket over the overlapping layers, wherein the heating jacket performs the heating of the overlapping layers on the body.

13. A method comprising:

creating spikes on a metal body of a liner hanger;

applying a fluoroplastic sleeve to the metal body between the spikes; and adding a welding filler to a void in the fluoroplastic sleeve.

14. The method of claim 13 further comprising:

spirally cutting the fluoroplastic sleeve.

15. The method of claim 13 comprising:

installing metal rings on the metal body and in contact with the fluoroplastic sleeve; and crimping the metal rings.

16. A method comprising:

creating spikes on a metal body of a liner hanger; and applying a fluoroplastic sleeve to the metal body between the spikes, wherein applying includes wrapping two or more fluoroplastic layers around the metal body of the liner hanger such that portions of the wrapped fluoroplastic layers overlap; and heating the overlapping fluoroplastic layers to conform the overlapping portions of the fluoroplastic layers to the body of the liner hanger.

17. The method of claim 16, wherein creating the spikes includes machining the metal body to form the spikes.

18. The method of claim 16, further comprising:

spirally cutting the fluoroplastic sleeve.

19. The method of claim 16, wherein heating the fluoroplastic sleeve includes placing a heating jacket over the sleeve, wherein the heating jacket performs the heating of the fluoroplastic sleeve on the body.

* * * * *